United States Patent [19]

Culbertson et al.

[11] Patent Number: 4,643,357

[45] Date of Patent: Feb. 17, 1987

[54] RAPIDLY CLEANABLE ATOMIZER

[75] Inventors: Samuel W. Culbertson, Arvada; James S. Merritt, LaFayette, both of Colo.

[73] Assignee: Binks Manufacturing Company, Franklin Park, Ill.

[21] Appl. No.: 800,781

[22] Filed: Nov. 22, 1985

[51] Int. Cl.[4] ..... B05B 3/10; B05B 15/02

[52] U.S. Cl. ..... 239/112; 239/223

[58] Field of Search ..... 239/110, 112, 113, 120, 239/121, 223, 224, 700–703

[56] References Cited

U.S. PATENT DOCUMENTS 4,405,086 9/1983 Vetter ..... 239/224

4,505,430 3/1985 Rodgers et al. ..... 239/112

FOREIGN PATENT DOCUMENTS 2010061 9/1971 Fed. Rep. of Germany ..... 239/223

*Primary Examiner*—Andres Kashnikow

*Attorney, Agent, or Firm*—Gary, Juettner & Pyle

[57] ABSTRACT

A rapidly cleanable rotary atomizer is characterized by a passageway extending between a rearward coating material cup of the atomizer and a forward coating material feed surface, from an edge of which atomization occurs. The passageway initiates in the material cup at a non-zero radius from the atomizer axis and terminates on the material feed surface at the axis. During changes of coating material, the passageway enables flushing media to be introduced from the material cup onto the material feed surface immediately at the axis of rotation of the atomizer for quickly and thoroughly cleaning the entirety of the material feed surface.

6 Claims, 3 Drawing Figures

RAPIDLY CLEANABLE ATOMIZER

BACKGROUND OF THE INVENTION

The present invention relates to rotary atomizers for atomizing coating materials, and in particular to an improved rotary atomizer which may be rapidly and completely cleaned of coating material.

Various types of rotary paint atomizers, which have means for cleaning the devices of one color of paint in preparation for atomizing paint of another color, are known in the art. For example, the atomizer taught by U.S. Pat. No. 4,275,838 is surrounded by a shroud mounted for movement around and coaxial to the atomizer. During a painting operation, the shroud is retracted to a position allowing paint to be projected from the edge of the atomizer. Upon completion of the painting operation, incident to a change in color of coating material to be atomized, the shroud is moved forwardly to a point whereat it surrounds the atomizer. A flushing nozzle in the shroud faces toward the paint feed surface at about the axis of the atomizer when the shroud is in its forward position, and a stream of flushing media is directed onto the surface at about the axis to rinse any paint residue from the surface. Upon completion of flushing, the shroud is moved rearwardly to its position away from the atomizing edge of the device and paint of a new color is supplied to the device. Although the arrangement cleans the atomizer, simpler flushing systems are available which avoid use of a separate flushing nozzle carried in a reciprocable shroud.

One such cleaning system is disclosed by U.S. Pat. No. 4,405,086 to Vetter, in which paint is delivered through a passage extending coaxial to the axis of rotation of the atomizer, into a rearward paint cup of the device. A passageway extends between the paint cup and a forward paint feed surface of the atomizer from an edge of which paint is projected, and the passageway both begins in the paint feed cup and terminates on the paint feed surface along the axis of the atomizer. Paint is introduced into the paint cup through a nozzle coaxially aligned with the inlet to the passageway, and to prevent paint from squirting out of the end of the passageway and beyond the paint feed surface, the passageway follows a labyrinth path between the paint cup and paint feed surface, first diverging radially outwardly and then radially inwardly. However, to provide the labyrinth path requires tapping a plurality of angulated passages through a center hub on the rearward side of the wall between the paint feed cup and paint feed surface, which adds complexity and cost to the manufacture of the device. At the same time, because paint introduced into the cup is directed in a jet against the inlet to the passageway, there is an increased pressure of paint in the passageway, in consequence of which paint has a tendency to be projected beyond the paint feed surface as it exists the passageway.

Another rotary atomizer which may be cleaned without use of a separate flushing nozzle in a shroud is taught by U.S. Pat. No. 4,505,430 to Rodgers et al. In that atomizer, a plurality of passageways extend between a rearward paint cup and a forward paint feed surface of the device, from an edge of which surface atomization occurs. The passageways initiate in the paint cup at a first non-zero radius and terminate on the paint feed surface at a second and smaller non-zero radius radially inwardly from the first radius. The passageways are angled both in the radial direction and tangentially, such that the tangential inclination is in a direction opposite the direction of rotation of the atomizer. Two separate nozzles extend into the paint cup, one for paint and one for cleaning solution, and during cleaning of the atomizer the nozzle for cleaning solution forcefully directs the solution into inner ends of the passageways as they rotate past the nozzle. One disadvantage of the device is that because the passageways terminate on the paint feed surface at a nonzero radius outwardly from the axis of rotation, the very center of the surface is not cleaned of paint residue. Also, the large number of passageways required and their particular angulation add cost to the manufacture of the device.

OBJECT OF THE INVENTION

The primary object of the present invention is to provide an improved rotary atomizer which is of simplified construction and may rapidly and completely be cleaned of paint residue during a flushing operation.

SUMMARY OF THE INVENTION

In accordance with the present invention, a rotary atomizer comprises a device having a forward material feed surface which flares generally outwardly from an axis of rotation of the device and which terminates at an atomizing edge from which material is projected, a rearward surface facing in a direction generally opposite that which the forward surface faces, and a passageway extending between said rearward and forward surfaces to provide for delivery of material to said forward surface to be projected from said atomizing edge when said device is rotated about said axis, said passageway beginning at a non-zero radius on said rearward surface and terminating on said forward surface at said axis.

The foregoing and other objects, advantages and features of the invention will become apparent upon consideration of the following detailed description when taken in conjunction with the accompanying drawings.

DETAILED DESCRIPTION

Figure 1:
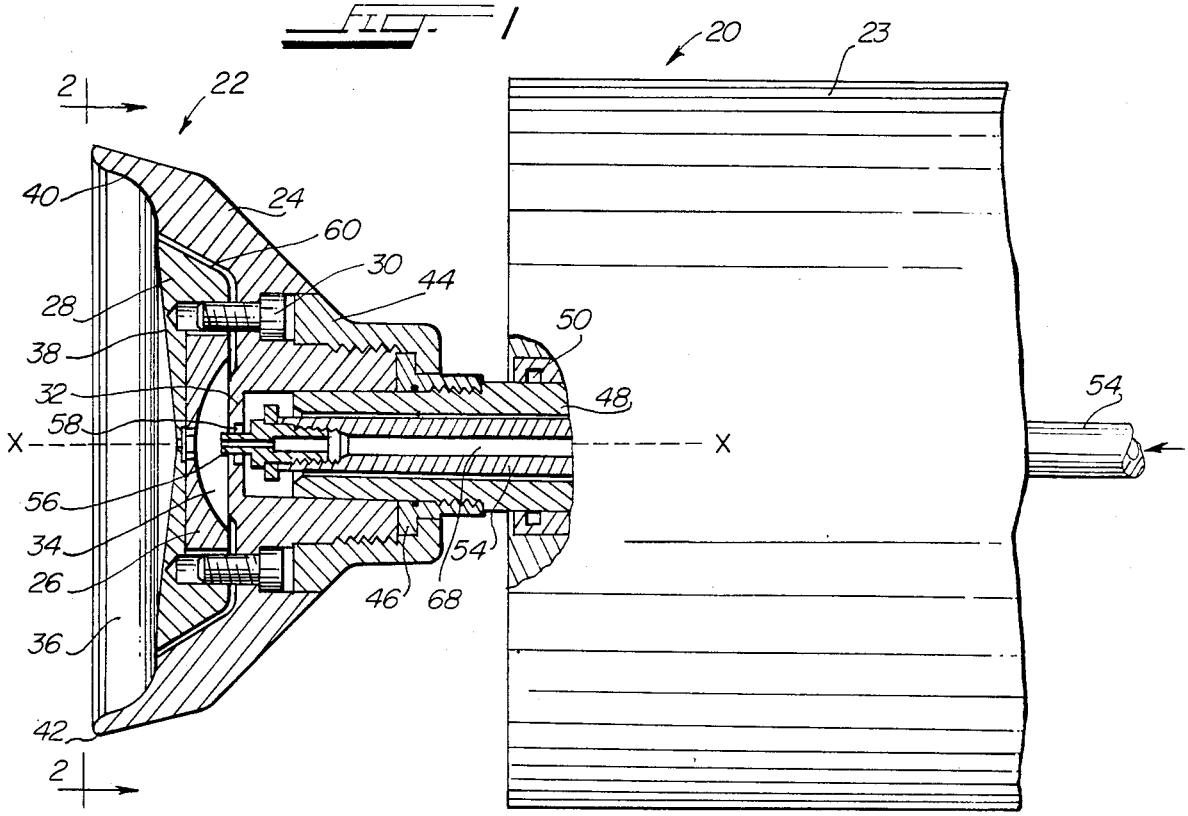
FIG. 1 is a cross sectional side elevation view of a rotary atomizer constructed according to the teachings of the present invention.

Referring to the drawings, an apparatus according to the present invention is indicated at 20 and includes a rotary cup-shaped atomizing device or atomizer, indicated generally at 22, rotatable by motor means 23 about an axis X—X. The atomizer comprises a cup portion 24 carrying centrally therein a restrictor 26 and an umbrella 28 which are mounted on the cup by fasteners 30. Defined between a rearward concave surface of the restrictor and a rearward wall 32 of the cup is a so-called paint cup 34, into which is delivered either coating material or flushing media, as will be described. Forwardly of the paint cup the atomizer has a cup-shaped interior 36 defined by a paint feed surface 38 of the umbrella and a paint feed surface 40 of the cup, which flares generally outwardly and terminates in an atomizing edge 42.

To mount the atomizer 22 for rotation, a retainer 44 is threaded onto a rearward extension of the cup 24, and captures between a rearward radially inwardly extending flange thereof and a rearward end of the cup a radially outwardly extending flange of a swivel nut 46. The swivel nut is in turn threaded onto a rotary shaft 48 journaled in bearings 50 of the motor means 23, which motor means preferably comprises a high speed air-driven turbine for rotating the atomizer at about 40,000 rpm.

To supply either coating material or flushing media to the paint cup 34, a delivery tube 54 extends centrally through the shaft 48 along the axis of the atomizer 22, and carries a nozzle 56 at its forward end. A forward end of the nozzle extends into the paint cup through an opening 58 in the rearward wall 32 of the cup 24, and the delivery tube, on the side of the motor means 23 opposite from the atomizer, is connectable in a conventional manner by means of valves (not shown) with either a supply of coating material under pressure or a supply of flushing media under pressure, thereby to deliver one or the other to the paint cup.

Figure 2:
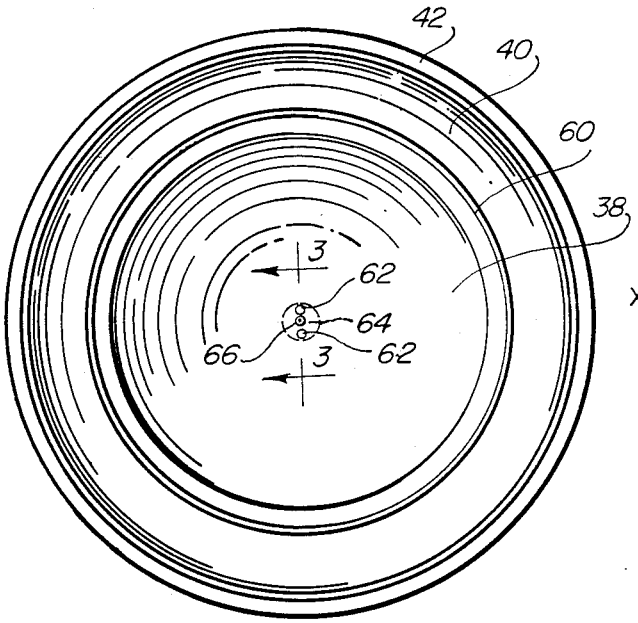
FIG. 2 is a front elevation view, taken along the lines 2—2 of FIG. 1, showing a forward paint feed surface of the atomizer.
Figure 3:
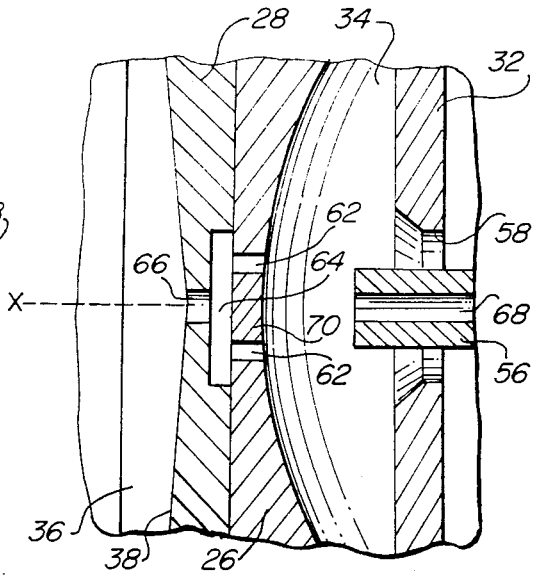
FIG. 3 is a fragmentary, cross sectional side elevation view taken substantially along the lines 3—3 of FIG. 2, illustrating a passageway extending between a rearward paint cup and the forward paint feed surface of the atomizer, through which passageway flushing solution flows for thoroughly and rapidly cleaning the entirety of the atomizer.

To deliver coating material or flushing media from the paint cup 34 to the paint feed surfaces 38 and 40, the umbrella 28 is mounted in spaced relationship from the cup 24 to define a generally annular passage 60 from the paint cup to the interior 36 of the atomizer 22 between the surfaces 38 and 40, through which a flow of coating material or flushing media is accommodated from the paint cup to the paint feed surface 40. Also, and in accordance with the teachings of the invention, a passageway extends between the paint cup and the axial center of the paint feed surface 38. With particular reference to FIGS. 2 and 3, the second passageway comprises a pair of passages 62 extending axially forward through the restrictor 26 between the paint cup and a cylindrical or annular chamber 64 formed in the surface of the umbrella 28 that abuts the restrictor. The passages 62 are diametrically opposed and radially outwardly from the axis of the atomizer, and extending axially forward from the chamber onto the axial center of the paint feed surface 38 is a passage 66. A center passage 68 of the delivery tube 54 and nozzle 56 exits from the nozzle into the paint cup along the axis of rotation of the atomizer, so that by virtue of the passages 62 being radially offset from the axis of the atomizer, the jet of coating material or flushing media emitted by the nozzle is impinged against a solid center portion of the restrictor 26, and not against inlets to the passages 62, thereby to fill the paint cup with a pressurized supply of coating material or flushing media without undue pressurization occurring within the passageway.

In consequence of the particular structure of the rotary atomizer 22, coating material introduced through the delivery tube 54 exits the forward end of the nozzle 56, impinges against the center portion 70 of the restrictor 26 and fills the paint cup 34 for flow through both the center passageway comprising the passages 62, chamber 64 and passage 66, onto the axial center of the paint feed surface 38, as well as for flow through the annular passage 60 onto the paint feed surface 40, whereby coating material on the paint feed surface 38 joins that on the paint feed surface 40 for being emitted in an atomized spray from the edge 42 of the atomizer. As is conventional and although not shown, it is to be understood that in use of the apparatus to provide a coating on an article, the rotary atomizer 22 would be maintained at a high d.c. voltage and the article would be grounded, so that electrostatic deposition of coating material on the article would take place.

After the coating operation and when it is desired to clean the atomizer of coating material, particularly when a change is being made from coating material or paint of one color to another, flushing media is introduced through the delivery tube 54 into the paint cup 34. The flushing media may comprise a pressurized mixture of cleaning solvent and air or intermittent applications of cleaning solvent and air, and exits the paint cup both through the annular passage 60 and the second, generally central passageway comprising the passages 62, chamber 64 and passage 66. Because the passage 66 opens onto the axial center of the paint feed surface 38, flushing media flows under centrifugal force over the entirety of the paint feed surfaces 38 and 40, and completely cleans the interior 36 of the atomizer.

The particular structure of the apparatus is thus such that flushing media thoroughly cleanses the interior of the atomizer without need for a reverse-oriented spray nozzle mounted on a cleaning shroud as in aforementioned U.S. Pat. No. 4,275,838. Since color changes typically occur with systems of the type described when no article to be coated is before the atomizing device, and since relatively less solvent is required with the present system than with that of U.S. Pat. No. 4,275,838 to clean the device satisfactorily, the shroud can be eliminated to reduce the cost and complexity of the system. At the same time, as compared with the device of aforementioned U.S. Pat. No. 4,405,086, the structure of the atomizer of the invention is greatly simplified and its manufacture is accomplished in an economical manner. Further, as compared with the device of aforementioned U.S. Pat. No. 4,505,430, the present invention enables the entirety of the paint feed surfaces on the interior of the rotary atomizer to be thoroughly cleaned of paint residue, so that there is no contamination of a subsequently supplied color of paint.

While one embodiment of the invention has been described in detail, various modifications and other embodiments thereof may be devised by one skilled in the art without departing from the spirit and scope of the invention, as defined in the appended claims.

What is claimed is:

1. A rotary material atomizer, comprising a cup-shaped device having a forward material flow surface which flares generally outwardly from an axis of rotation and which terminates at an atomizing edge from which material is discharged; means for mounting said device along said axis for rotation about said axis, said device having a material cup on a rearward side thereof rearwardly of said forward surface and a circular wall extending generally perpendicular to said axis between said material cup and forward surface, a front surface of said wall defining a central portion of said forward surface and a rear surface of said wall defining a front side of said material cup; means defining a passageway through said wall for delivery of material from said cup to said forward surface for flow across said forward surface to said atomizing edge for being discharged from said edge, said passageway beginning at a nonzero radius from said axis in said material cup and terminating on said forward surface at a zero radius on said axis, said material cup being unobstructed in all radial directions from said axis to at least said non-zero radius and said non-zero radius being less than the radius of said circular wall; and means for introducing a jet of material into said material cup along said axis for impingement against said wall rear surface at said axis for flow through said cup to and through said passageway to said forward surface.

2. A rotary material atomizer as in claim 1, wherein said passageway extends through said wall axially forward from said material cup to a point toward but spaced from said forward surface, then radially inwardly to said axis, and then axially forwardly to said forward surface.

3. A rotary material atomizer as in claim 1, wherein said passageway comprises an annular chamber within said wall coaxial with said axis and between and spaced from said wall front and rear surfaces, a first passage beginning at said non-zero radius in said material cup and extending axially forwardly through said wall to said chamber, and a second passage extending through said wall along said axis between said chamber and said forward surface.

4. A rotary material atomizer as in claim 3, wherein said passageway further includes a third passage beginning at said non-zero radius from said axis in said material cup diametrically opposite from said first passage and extending through said wall axially forward to said chamber, said first and third passages conveying material introduced into said material cup to said annular chamber for flow of the material to and through said second passage to said forward surface.

5. A rotary material atomizer as in claim 4, including a second passageway extending between said material cup and said forward surface for delivery of material to said surface, said second passageway being generally annular, unobstructed, outwardly of the circumferential periphery of said circular wall, and having an arcuate extent of 360° and circumscribing said first, second and third passages and said annular chamber.

6. A rotary material atomizer as in claim 5, wherein said introducing means includes means for introducing either coating material or flushing media into said material cup along said axis, said introducing means, when introducing flushing media, providing for cleansing of coating material from said atomizer.

* * * * *